US006257571B1

(12) United States Patent
Kniss et al.

(10) Patent No.: US 6,257,571 B1
(45) Date of Patent: Jul. 10, 2001

(54) EDGE TAMPING MECHANISM

(75) Inventors: James Kniss; David Thayer, both of Chester, CT (US)

(73) Assignee: GBR Systems Corporation, Chester, CT (US)

( * ) Notice: Subject to any disclaimer, the term of this patent is extended or adjusted under 35 U.S.C. 154(b) by 0 days.

(21) Appl. No.: 09/428,444

(22) Filed: Oct. 28, 1999

(51) Int. Cl.[7] ..... B65H 29/00; B65H 31/36; B65H 31/20

(52) U.S. Cl. ..... 271/181; 271/220; 271/221; 271/223; 271/901

(58) Field of Search ..... 271/181, 220, 271/221, 223, 901

(56) References Cited

U.S. PATENT DOCUMENTS

| | | |
|---|---|---|
| 197,477 | 11/1877 | Kneeland . |
| 281,150 | 7/1883 | Smith et al. . |
| 470,898 | 3/1892 | Reiffel . |
| 899,133 | 9/1908 | Ranz . |
| 1,032,378 | 7/1912 | Chandler . |
| 1,086,353 | 2/1914 | Dick . |
| 1,236,181 | 8/1917 | Kast . |
| 1,448,705 | 3/1923 | Chisholm . |
| 1,478,464 | 12/1923 | Waters . |
| 1,528,450 | 3/1925 | Neckerman . |
| 1,573,414 | 2/1926 | Mahoney . |
| 1,595,384 | 8/1926 | Cochran . |
| 1,617,874 | 2/1927 | Swanson . |
| 1,685,873 | 10/1928 | Evans et al. . |
| 1,712,808 | 5/1929 | Bing . |
| 1,887,023 | 11/1932 | Hunziker . |
| 2,005,370 | 6/1935 | Hughey . |
| 2,094,665 | 10/1937 | Mudd . |
| 2,157,228 | 5/1939 | Buccicone et al. . |
| 2,162,889 | 6/1939 | Hormel . |
| 2,215,091 | 9/1940 | Adatte et al. . |
| 2,228,887 | 1/1941 | Peterson . |
| 2,332,600 | 10/1943 | Rapp . |
| 2,406,489 | 8/1946 | Case . |
| 2,461,418 | 2/1949 | Ford . |
| 2,472,931 | 6/1949 | Yohn . |
| 2,533,422 | 12/1950 | Braun . |
| 2,561,015 | 7/1951 | Davidson . |
| 2,606,669 | 8/1952 | Morrison . |
| 2,626,800 | 1/1953 | Martin . |
| 2,635,002 | 4/1953 | Davidson et al. . |
| 2,640,605 | 6/1953 | Chatterton . |
| 2,733,064 | 1/1956 | Martin . |
| 2,753,185 | 7/1956 | Johnson . |
| 2,760,809 | 8/1956 | Mallin . |
| 2,761,682 | 9/1956 | Buccicone . |
| 2,805,858 | 9/1957 | Hayes . |
| 2,844,373 | 7/1958 | Van Marle . |
| 2,850,281 | 9/1958 | Heimlicher et al. . |
| 2,887,863 | 5/1959 | Cooper . |
| 2,893,254 | 7/1959 | Grover . |
| 2,938,721 | 5/1960 | Buckingham et al. . |
| 2,944,813 | 7/1960 | Smith . |
| 3,051,479 | 8/1962 | Gore . |
| 3,095,192 | 6/1963 | Simjian . |
| 3,180,190 | 4/1965 | Haselow . |

(List continued on next page.)

*Primary Examiner*—Joseph E. Valenza
*Assistant Examiner*—Jeffrey A. Shapiro
(74) *Attorney, Agent, or Firm*—Joseph J. Previto

(57) ABSTRACT

A tamping mechanism for tamping the edge of sheets in a stack including a tamping assembly having a tamping blade. The tamping blade is positioned adjacent an edge of a stack of sheets and is moved toward and away from the edge. Magnets are provided to move the tamping blade toward and away from the edge. The tamping blade has one magnet and another magnet is movable into and out of magnetic interaction of the said first magnet. The second magnet is in a wheel adjacent tamping blade. The wheel has a plurality of magnets and is rotated so that the magnets in the wheel are moved into and out of magnetic interaction with the magnet in the tamping blade.

35 Claims, 3 Drawing Sheets

U.S. PATENT DOCUMENTS

| | | | | |
|---|---|---|---|---|
| 3,198,519 | | 8/1965 | Bartsch . | |
| 3,278,178 | | 10/1966 | Eckl . | |
| 3,307,716 | | 3/1967 | Ross . | |
| 3,334,895 | | 8/1967 | Daniels et al. . | |
| 3,367,652 | | 2/1968 | Stobb . | |
| 3,438,309 | | 4/1969 | Boileau . | |
| 3,556,511 | | 1/1971 | Howard et al. . | |
| 3,556,513 | | 1/1971 | Howard . | |
| 3,565,420 | | 2/1971 | Howard . | |
| 3,672,663 | | 6/1972 | Tomlinson . | |
| 3,782,591 | | 1/1974 | Fries . | |
| 3,790,004 | * | 2/1974 | Tole et al. | 414/790.3 |
| 3,804,514 | | 4/1974 | Jasinski . | |
| 3,815,896 | | 6/1974 | Hoyer . | |
| 3,858,732 | | 1/1975 | Kemper . | |
| 3,862,752 | | 1/1975 | Totten . | |
| 3,869,116 | | 3/1975 | Kroeker . | |
| 3,884,368 | * | 5/1975 | Ballard | 414/797 |
| 3,907,274 | * | 9/1975 | D'Amato et al. | 271/300 |
| 3,910,570 | | 10/1975 | Bleau . | |
| 3,918,700 | | 11/1975 | Donner . | |
| 4,033,579 | | 7/1977 | Stange et al. . | |
| 4,043,460 | | 8/1977 | Steele . | |
| 4,076,408 | | 2/1978 | Reid et al. . | |
| 4,138,102 | | 2/1979 | Palmer . | |
| 4,164,347 | | 8/1979 | McGrain . | |
| 4,169,674 | | 10/1979 | Russel . | |
| 4,189,133 | | 2/1980 | Arrasmith et al. . | |
| 4,219,192 | | 8/1980 | Burke . | |
| 4,221,378 | | 9/1980 | Kamath et al. . | |
| 4,231,562 | | 11/1980 | Hori . | |
| 4,302,000 | * | 11/1981 | Frank | 271/150 |
| 4,334,674 | | 6/1982 | Ishii . | |
| 4,372,547 | | 2/1983 | Yanagawa et al. . | |
| 4,405,123 | | 9/1983 | Takeyama et al. . | |
| 4,440,387 | | 4/1984 | Ikoma et al. . | |
| 4,469,320 | | 9/1984 | Wenthe, Jr. . | |
| 4,575,067 | | 3/1986 | Ciatteo . | |
| 4,611,741 | | 9/1986 | Wilson . | |
| 4,611,800 | | 9/1986 | Parsons et al. . | |
| 4,639,128 | | 1/1987 | Anderson . | |
| 4,768,912 | | 9/1988 | Miura . | |
| 5,018,717 | * | 5/1991 | Sadwick et al. | 271/207 |
| 5,026,034 | | 6/1991 | Russel et al. . | |
| 5,044,625 | * | 9/1991 | Reid | 271/293 |
| 5,054,764 | * | 10/1991 | Phillips et al. | 271/189 |
| 5,120,046 | * | 6/1992 | Mandel et al. | 271/220 |
| 5,228,792 | * | 7/1993 | Crevecouer et al. | 400/630 |
| 5,390,907 | * | 2/1995 | Dole | 271/214 |
| 5,518,230 | * | 5/1996 | Scarlata et al. | 271/186 |
| 5,576,691 | * | 11/1996 | Coakley et al. | 340/568 |
| 5,684,457 | * | 11/1997 | Miller et al. | 340/543 |

* cited by examiner

EDGE TAMPING MECHANISM

BACKGROUND

The present invention relates to a tamping mechanism and more particularly to an improved tamping mechanism for tamping the edges of a stack of sheets.

In present high-speed printing and paper assembling mechanisms, sheets of paper are fed at high speeds to an accumulating area where they are placed one on top of the other to form a stack. When the stack is complete (i.e. a predetermined number of sheets are accumulated) the stack is moved to other stations which perform other functions on the stack. It is important that the edges of the stack of sheets be straight and in alignment with each other so that when the stack of sheets move to another station, there will be no sheet with its edge protruding outside the edge of the stack. Hence, it is important to tamp the sheets edgewise on both edges after they are deposited on a stack. This will straighten out all the edges of a stack and move them into alignment with each other.

OBJECTS

The present invention is an improvement over existing tamping mechanisms and has for one of its objects the provision of an improved tamping mechanism in which the edges of the stack are tamped after each sheet is laid on top of the stack.

Another object of the present invention is the provision of an improved tamping mechanism in which simple means are provided for tamping the edges of the stack and straightening out the edges.

Another object of the present invention is the provision of an improved tamping mechanism which can operate at the speeds necessary for present high-speed printing and assembling mechanisms.

Other and further objects will be obvious upon the understanding of the illustrative embodiment about to be described, or which will be indicated in the appended claims, and various advantages not referred to herein, will occur to one skilled in the art upon employment of the invention in practice.

DRAWINGS

A preferred embodiment of the invention has been chosen for purposes of illustration and description and is shown in the accompanying drawings forming a part of the specification wherein.

DESCRIPTION

Figure 1:
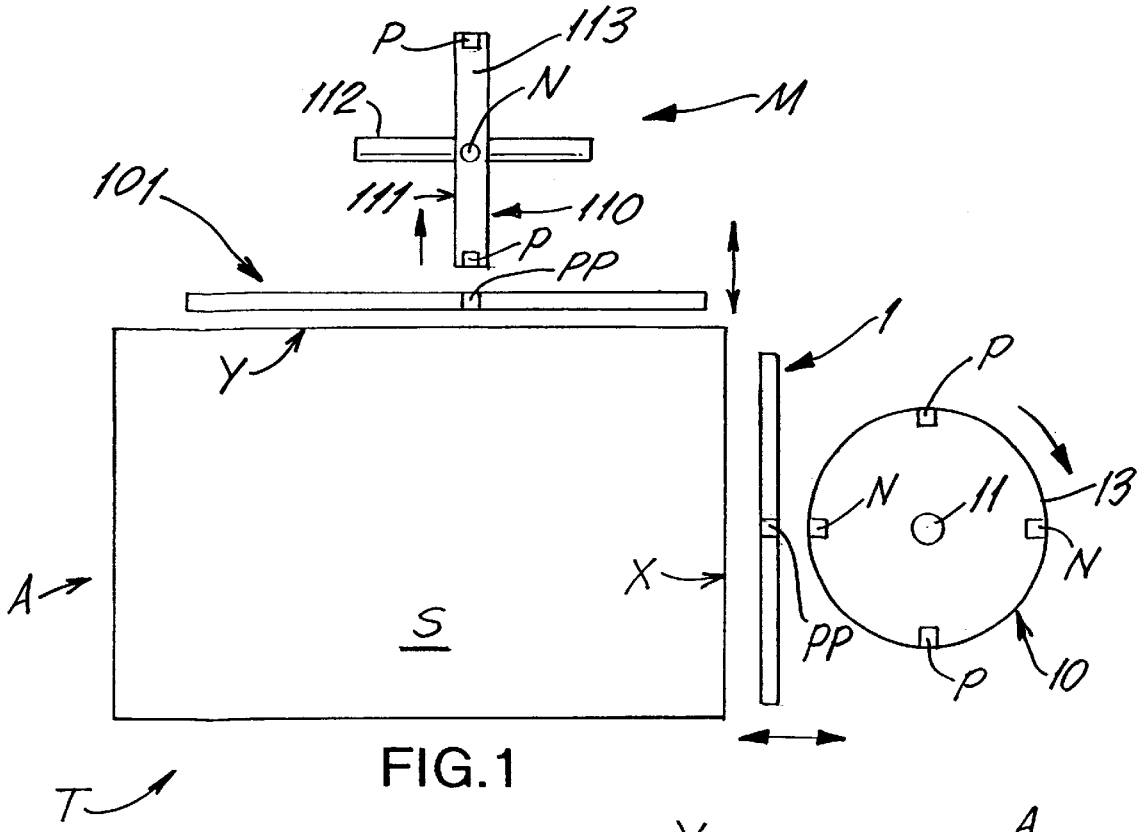
FIG. 1 is a simplified, diagrammatic plan view showing a tamping mechanism made in accordance with the present invention.

Referring to the drawings and more particularly to FIG. 1, sheets of paper S are fed to an accumulating area to form a stack A. The sheets S and the stack A have registration edges X and Y which are right angles to each other. It is important that these edges X and Y be in registry or alignment with each other throughout the entire stack so that when the stack A is complete and is moved to another station, there are no sheets with edges protruding beyond the edges X and Y of the stack. In order to accomplish this, a tamping mechanism T is provided which includes tamping assemblies L and M positioned alongside each edge X and Y of the stack, respectively. The tamping assemblies L and M have tamping blade assemblies 1 and 101 which are at right angles to each other and are adapted to move toward and away from the stack A. As each sheet is deposited on top of the stack A, the tamping blade assemblies L and M move forward against the stack A in order to tamp and align the edges of the newly deposited sheet S with the edges of the previously deposited sheets S in the stack A. In this manner, all the edges X and Y of the stack A are in registry with each other without any sheet S in the stack A having an edge which protrudes from the edges X and Y in the rest of the stack A.

The mechanism for moving the tamping blade assembly 1 to strike edge X of the stack comprises a wheel assembly 10 having wheel 11 rotatable on an axis 12 and having a plurality of permanent magnets P and N along its edge. In the drawings the permanent magnets P and N are shown as being positive and negative magnets which are alternately located along the edge 13 of the wheel 11. The tamping blade assembly also has a permanent magnet PP therein which in the drawings is depicted as being a positive magnet. As the wheel 11 rotates, the positive and negative magnets P and N are moved adjacent to and within the magnetic flux of the positive magnet of PP in the tamping blade assembly 1. When the positive magnet P in the wheel 11 moves adjacent to the positive magnet PP in the tamping blade assembly 1, the two magnets P and PP repel each other and the blade assembly 1 is moved forward against the edge X of the stack A to tamp this stack edge. As the wheel 11 continues to rotate, the negative magnet N in the wheel 11 is moved adjacent the positive magnet PP in the tamping blade assembly 1, the two magnets attract each other and the tamping blade assembly 1 is moved away from the edge X of the stack A. As each sheet S is deposited on the stack A and the magnetic wheel 11 continues to rotate, the magnetic attraction and repulsion between the magnet PP in the tamping blade assembly 1 and the magnets N and P in the wheel 11 will move the tamping blade assembly 1 away from and against the stack A so that all edges X will be tamped as the sheets S are deposited on the stack A.

The mechanism for moving the tamping blade assembly 101 against the edge X comprises a wheel assembly 110 having a wheel 111 rotatable on a shaft 112 and having a plurality of permanent magnets P and N of alternating positive and negative polarity in its edge 113. The tamping blade assembly 101 also has a permanent magnet PP thereon which in the drawing is depicted as being a magnet of positive polarity. As the wheel 111 rotates, the positive magnet P moves adjacent the positive magnet PP in the tamping blade assembly 101 and the two magnets will repel each other thereby moving the tamping blade assembly 101 against the edge Y of the stack A to tamp that edge. As the wheel 111 continues to rotate the negative magnet N is now placed into adjacency with the positive magnet PP in the taping blade assembly 101. The two magnets attract each other so that the tamping blade 101 now moves away from the stack A. As additional sheets S are placed on the stack A, and the wheel 111 continues to rotate, the tamping blade assembly 101 is moved back and forth against the edge Y of the stack S and away therefrom to tamp the edge Y as the sheets S are deposited on stack A.

Figure 3:
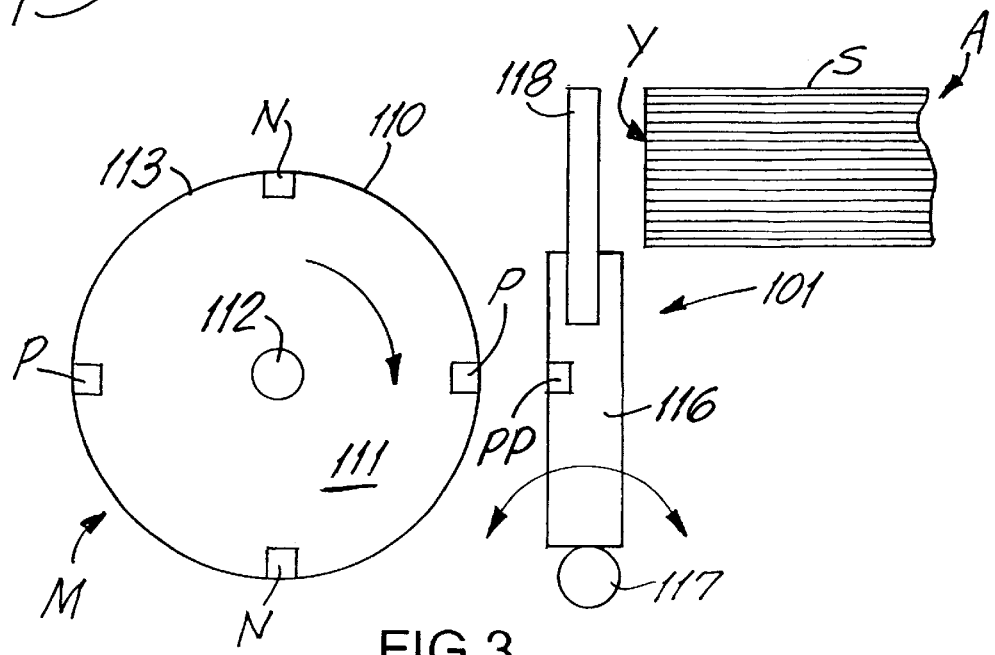
FIG. 3 is a simplified, diagrammatic view showing the mechanism for tamping another edge of the stack.
Figure 2:
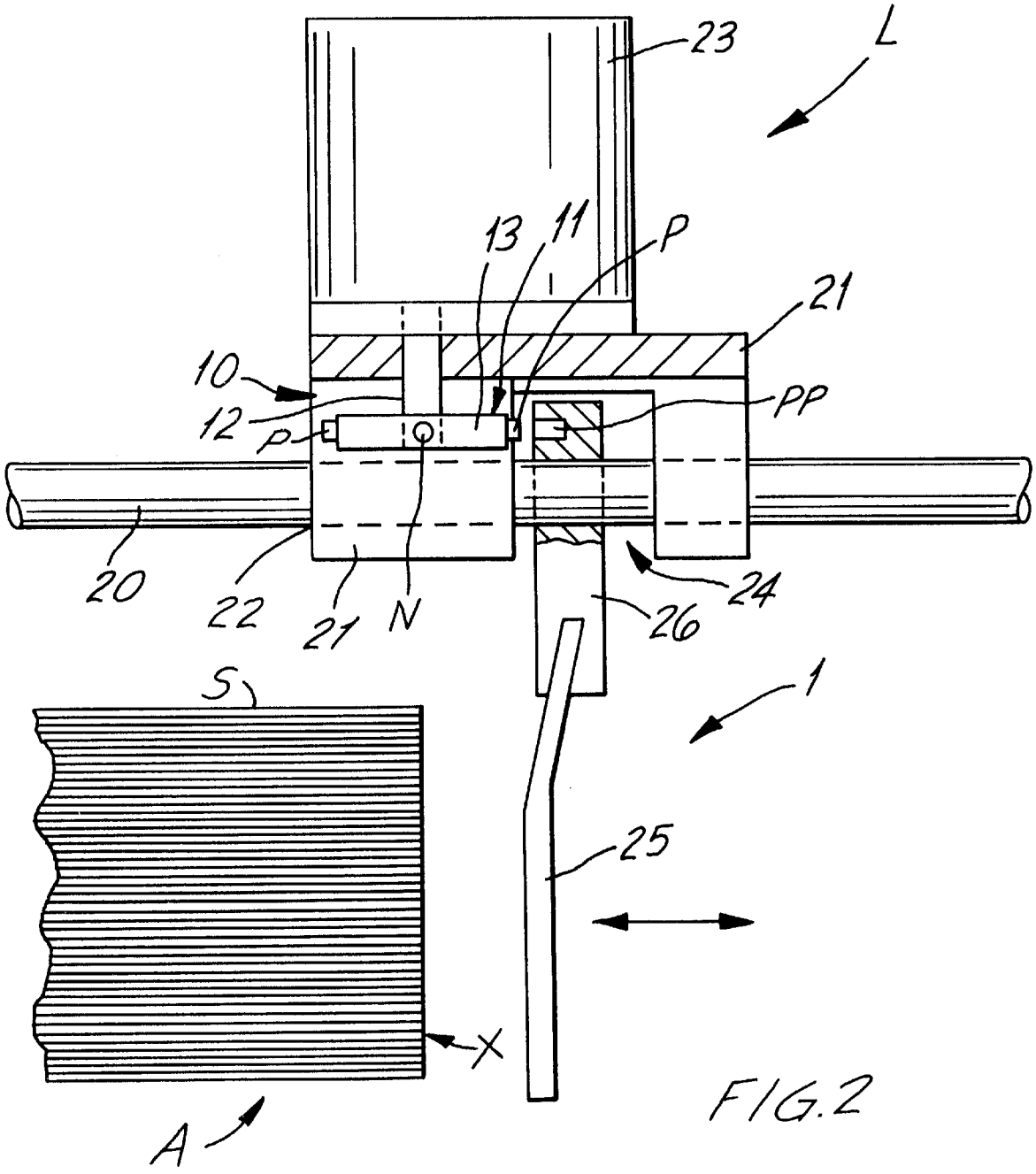
FIG. 2 is a simplified, diagrammatic view showing the mechanism for tamping one edge of the stack.
Figure 4:
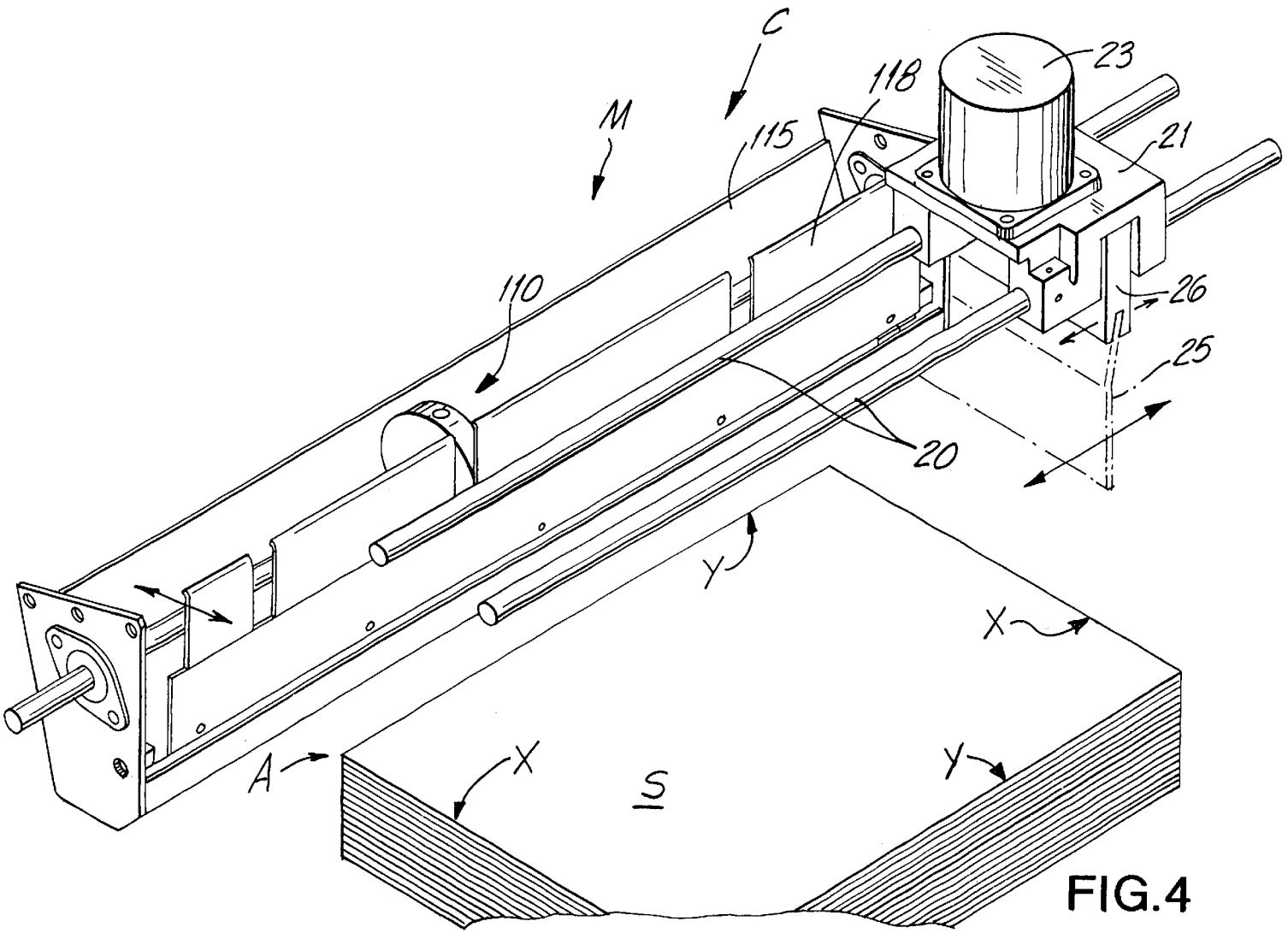
FIG. 4 is a simplified, diagrammatic perspective view showing a tamping mechanism made in accordance with the present invention.

Referring to FIGS. 2 to 4, the tamping assemblies L and M which tamp the edges X and Y of the stack are mounted on a unitary tamping mechanism referred to generally as C. The tamping assembly M to tamp the edge Y comprises the wheel assembly 110 which has a vertically mounted wheel 111 mounted on and rotated by a shaft 112 journalled in a frame 115. Adjacent to the wheel assembly 110 is the tamping blade assembly 101 comprising a block 116 mounted on pivot 117 opposite the wheel 111 and which has a positive magnet PP and which will pivot back and forth on pivot 117 as the magnets N and P on the edge 113 of the wheel 111 come into and out of magnetic influence with magnet PP. The block 116 has a tamping blade 118 extending upwardly therefrom and lies adjacent the edge Y of the stack to be tamped. This blade 118 moves back and forth with the block 116 and will strike the edge Y of the stack A and tamp it as each sheet S is deposited on the stack A.

The tamping assembly L to tamp the edge X comprises a pair of horizontally oriented parallel rods 20. A block 21 having openings 22 therein is mounted on the rods 20 which extend through the openings 22 so that the block 21 can slide back and forth along the rods 20. A motor assembly 23 is mounted on the block 21 with its shaft 12 extending downwardly and supporting the wheel 11 which has the magnets N and P on its edge. A tamping slide 26 has a pair of openings 23 through which the rods 20 extend in order to permit the slide 22 to move back and forth along the rods 20. The tamping slide 26 is mounted in a u-shaped channel 24 formed in the block 21 and has a magnet PP therein at approximately in the same level as the magnets N and P in the wheel 11. Extending downwardly from the tampering slide 26 is a tamping blade 25 which is adjacent the edge X of the stack A. In this manner, as the motor assembly 23 rotates the wheel 11, the magnets N and P in the wheel 11 move into and out of position adjacent the magnet PP in the slide 26 to move slide 26 back and forth in order to tamp the edge X.

In operating the mechanism as described hereinabove, the stack A is first placed with the edge Y adjacent the tamping assembly M. Because of differences in the size of sheets, the second edge X of the stack may not be near the second tamping assembly L. In this event, the entire tamping assembly L is moved along the rods 20 and placed in a position adjacent the edge X of the stack. The two tamping assemblies L and M can now be used to tamp both edges X and Y as soon as each sheet S is deposited on the stack A.

It will be understood that although the drawings illustrate the permanent magnets PP on the tamping blade assemblies 1 and 101 to be positive polarity, it is within the purview of the present invention for the permanent magnets PP in the tamping blade assemblies 1 and 101 to be of negative polarity in which event when the positive permanent magnets P on the wheels 11 and 111 are adjacent the tamping blade assemblies 1 and 101 they will move against the edges X and Y and when the negative permanent magnets N are opposite the tamping blade assemblies 1 and 101 they will move away from the edges X and Y.

It will also be understood that while magnets P-N-PP have been disclosed in describing the present invention as permanent magnets, electromagnets may also be used without departing from the invention.

It will thus be seen that the present invention provides an improved tamping mechanism in which the edges of the stack are tamped after each sheet is laid on top of the stack, in which simple means are provided for tamping the edges of the stack and straightening out the edges, and which can operate at the speeds necessary for present high-speed printing and assembling mechanisms.

As many varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A tamping mechanism for tamping the edge of sheets in a stack comprising a tamping assembly having a tamping blade, said tamping blade being positioned adjacent an edge of a stack of sheets and means for moving the tamping blade toward and away said edge, wherein said tamping blade comprises first magnetic means therein and wherein said moving means comprises second magnetic means movable into and out of magnetic interaction of the said first magnetic means.

2. A tamping mechanism as set forth in claim 1 wherein magnetic means are provided to move the tamping blade toward and away from said edge.

3. A tamping mechanism as set forth in claim 2 wherein a wheel is provided adjacent the tamping blade, said wheel having at least one magnet therein and a means for rotating the wheel whereby the magnet in the wheel is moved into and out of magnetic interaction with the magnetic means in the tamping blade.

4. A tamping mechanism as set forth in claim 3 wherein said wheel has a plurality of magnets therein.

5. A tamping mechanism as set forth in claim 4 wherein said magnets are of different polarities.

6. A tamping mechanism as set forth in claim 5 wherein the magnets in said wheel are of alternate positive and negative polarity.

7. A tamping mechanism as set forth in claim 6 wherein said magnets are positioned along the edge of said wheel.

8. A tamping mechanism as set forth in claim 7 wherein said tamping mechanism comprises at least a pair of tamping assemblies which are mounted at an angle to each other and are adapted to tamp the edges of a stack of sheets, each having a tamping blade.

9. A tamping mechanism as set forth in claim 8 wherein one of said tamping assemblies comprises a vertically oriented wheel mounted adjacent a first tamping blade.

10. A tamping mechanism as set forth in claim 9 wherein means are provided for rotating said wheel in a vertical direction.

11. A tamping mechanism as set forth in claim 10 wherein one of said tamping assemblies comprises a horizontally oriented wheel mounted adjacent a second tamping blade.

12. A tamping mechanism as set forth in claim 11 wherein said horizontally oriented wheel is mounted on a carriage, said carriage being movable relative to the edge of a stack to be tamped.

13. A tamping mechanism as set forth in claim 12 wherein said carriage is slidable on a rod assembly.

14. A tamping mechanism as set forth in claim 13 wherein said carriage has means for rotating said wheel.

15. A tamping mechanism as set forth in claim 14 wherein the said second tamping blade depends from a slide slidably mounted for slidable movement on said rod assembly.

16. A tamping mechanism as set forth in claim 15 wherein said magnets are permanent magnets.

17. A tamping mechanism for tamping the edge of sheets in a stack comprising a tamping assembly having a tamping blade, said tamping blade being positioned adjacent an edge of a stack of sheets and means for moving the tamping blade toward and away said edge, said tamping assembly comprises a vertically oriented wheel mounted adjacent said tamping blade, and means for rotating that wheel in a vertical direction, wherein said tamping blade comprises first magnetic means therein and wherein said moving means comprises second magnetic means movable into and out of magnetic interaction of the said first magnetic means.

18. A tamping mechanism as set forth in claim 17 wherein magnetic means are provided to move the tamping blade toward and away from said edge.

19. A tamping mechanism as set forth in claim 18 wherein said wheel is provided adjacent the tamping blade, said wheel having at least one magnet therein and a means for rotating the wheel whereby the magnet in the wheel is moved into and out of magnetic interaction with the magnetic means in the tamping blade.

20. A tamping mechanism as set forth in claim 19 wherein said wheel has a plurality of magnets therein.

21. A tamping mechanism as set forth in claim 20 wherein said magnets are of different polarities.

22. A tamping mechanism as set forth in claim 21 wherein the magnets in said wheel are of alternate positive and negative polarity.

23. A tamping mechanism as set forth in claim 22 wherein said magnets are positioned along the edge of said wheel.

24. A tamping mechanism as set forth in claim 23 wherein said magnets are permanent magnets.

25. A tamping mechanism for tamping the edges of sheets in a stack comprising a tamping assembly having a tamping blade, said tamping blade being positioned adjacent an edge of a stack of sheets and means fro moving the tamping blade toward and away said edge, said tamping assembly comprises a horizontally oriented wheel, wherein said tamping blade comprises first magnetic means therein and wherein said moving means comprises second magnetic means movable into and out of magnetic interaction of the said first magnetic means.

26. A tamping mechanism as set forth in claim 25 wherein said horizontally oriented wheel is mounted on a carriage, said carriage being movable relative to the edge of a stack to be tamped.

27. A tamping mechanism as set forth in claim 26 wherein said carriage is slidable on a rod assembly.

28. A tamping mechanism as set forth in claim 27 wherein said carriage has means for rotating said wheel.

29. A tamping mechanism as set forth in claim 28 wherein the tamping blade depends from a slide mounted for slidable movement on said rod assembly.

30. A tamping mechanism as set forth in claim 29 wherein magnetic means are provided to move the tamping blade toward and away from said edge.

31. A tamping mechanism as set forth in claim 30 wherein said wheel is provided adjacent the tamping blade, said wheel having at least one magnet therein and a means for rotating the wheel whereby the magnet in the wheel is moved into and out of magnetic interaction with the magnetic means in the tamping blade.

32. A tamping mechanism as set forth in claim 31 wherein said wheel has a plurality of magnets therein.

33. A tamping mechanism as set forth in claim 32 wherein the magnets in said wheel are of alternate positive and negative polarity.

34. A tamping mechanism as set forth in claim 33 wherein the magnets in said wheel are positioned along the edge of said wheel.

35. A tamping mechanism as set forth in claim 34 wherein said magnets are permanent magnets.

* * * * *